US008808415B2

(12) United States Patent
Caro et al.

(10) Patent No.: US 8,808,415 B2
(45) Date of Patent: Aug. 19, 2014

(54) EXHAUST INTAKE BONNET (EIB) FOR MARITIME EMISSIONS CONTROL SYSTEM

(76) Inventors: Sal Caro, Camarillo, CA (US); Kevin Connolly, Ventura, CA (US); Jason McAuley, Port Hueneme, CA (US); Robert Sharp, Camarillo, CA (US)

( * ) Notice: Subject to any disclaimer, the term of this patent is extended or adjusted under 35 U.S.C. 154(b) by 1446 days.

(21) Appl. No.: 12/024,786

(22) Filed: Feb. 1, 2008

(65) Prior Publication Data

US 2009/0197489 A1 Aug. 6, 2009

(51) Int. Cl.
*B01D 17/00* (2006.01)
*B63H 21/00* (2006.01)

(52) U.S. Cl.
USPC ..... 55/385.1; 440/89 R

(58) Field of Classification Search
USPC ..... 440/88 R
See application file for complete search history.

(56) References Cited

U.S. PATENT DOCUMENTS

| | | | | |
|---|---|---|---|---|
| 1,013,358 | A | 1/1912 | Andrews | |
| 1,439,226 | A | 12/1922 | Clarke | |
| 4,099,452 | A | 7/1978 | Costen | |
| 4,442,766 | A | 4/1984 | Hawkins | |
| 4,637,300 | A | 1/1987 | Cole | |
| 4,756,359 | A | 7/1988 | Greer | |
| 4,912,928 | A | 4/1990 | Kaneko | |
| 5,092,226 | A | 3/1992 | McCloskey | |
| 5,281,246 | A | 1/1994 | Ray et al. | |
| 5,603,215 | A | 2/1997 | Sung et al. | |
| 5,460,301 | A | 3/1997 | Ebinger et al. | |
| 5,613,990 | A | 3/1997 | Diachuk | |
| 5,622,538 | A | 4/1997 | Diachuk | |
| 5,687,773 | A | 11/1997 | Ryan et al. | |
| 5,823,218 | A | 10/1998 | Schlecht et al. | |
| 5,827,490 | A | 10/1998 | Jones | |
| 5,842,918 | A | 12/1998 | Cowen | |
| 5,980,343 | A | 11/1999 | Rollinski | |
| 6,022,389 | A | 2/2000 | Vross et al. | |
| 6,176,082 | B1 | 1/2001 | Shaffer | |
| 6,244,918 | B1 | 6/2001 | Cameron | |
| 6,332,308 | B1 | 12/2001 | Miller | |
| 6,442,933 | B2 | 9/2002 | Rusch | |
| 6,463,958 | B1 | 10/2002 | Schwing | |
| 6,647,711 | B1 | 11/2003 | Spiegel et al. | |
| 6,660,239 | B2 | 12/2003 | Nagii | |
| 6,667,011 | B1 | 12/2003 | Munje et al. | |
| 6,726,736 | B2 * | 4/2004 | Koclejda et al. | 55/385.2 |
| 6,761,868 | B2 | 7/2004 | Brooks et al. | |
| 6,910,930 | B1 | 6/2005 | Mitchell | |
| 7,258,710 | B2 * | 8/2007 | Caro et al. | 55/385.1 |
| 7,275,366 | B2 | 10/2007 | Powell et al. | |
| 8,402,746 | B2 * | 3/2013 | Powell et al. | 60/281 |
| 2004/0144080 | A1 | 7/2004 | Suzuki et al. | |
| 2004/0163377 | A1 | 8/2004 | Liu | |
| 2007/0209544 | A1 * | 9/2007 | Caro et al. | 105/26.05 |

* cited by examiner

*Primary Examiner* — Ellen McAvoy
*Assistant Examiner* — Ming Cheung Po
(74) *Attorney, Agent, or Firm* — Kenneth L. Green

(57) ABSTRACT

An improved Exhaust Intake Bonnet (EIB) for an Advanced Maritime Emissions Control System (AMECS) includes a shroud carried by a rigid upper frame and a lowerable and raisable rigid lower frame. The upper frame includes a peak with a duct for receiving exhaust gasses captured by the shroud and winches for lowering and raising the lower frame. The shroud is expandable when the lower frame is lowered and collapsible when the lower frame is raised and has a cinchable base. The AMECS is joined to a ship by positioning the EIB over a ship's exhaust stack using a deployment arm. The shroud is then lowered over the stack and then cinched around the stack to provide a soft attachment between the EIB and the ship's stack. Later, the steps are reversed to separate the AMECS from the ship.

20 Claims, 7 Drawing Sheets

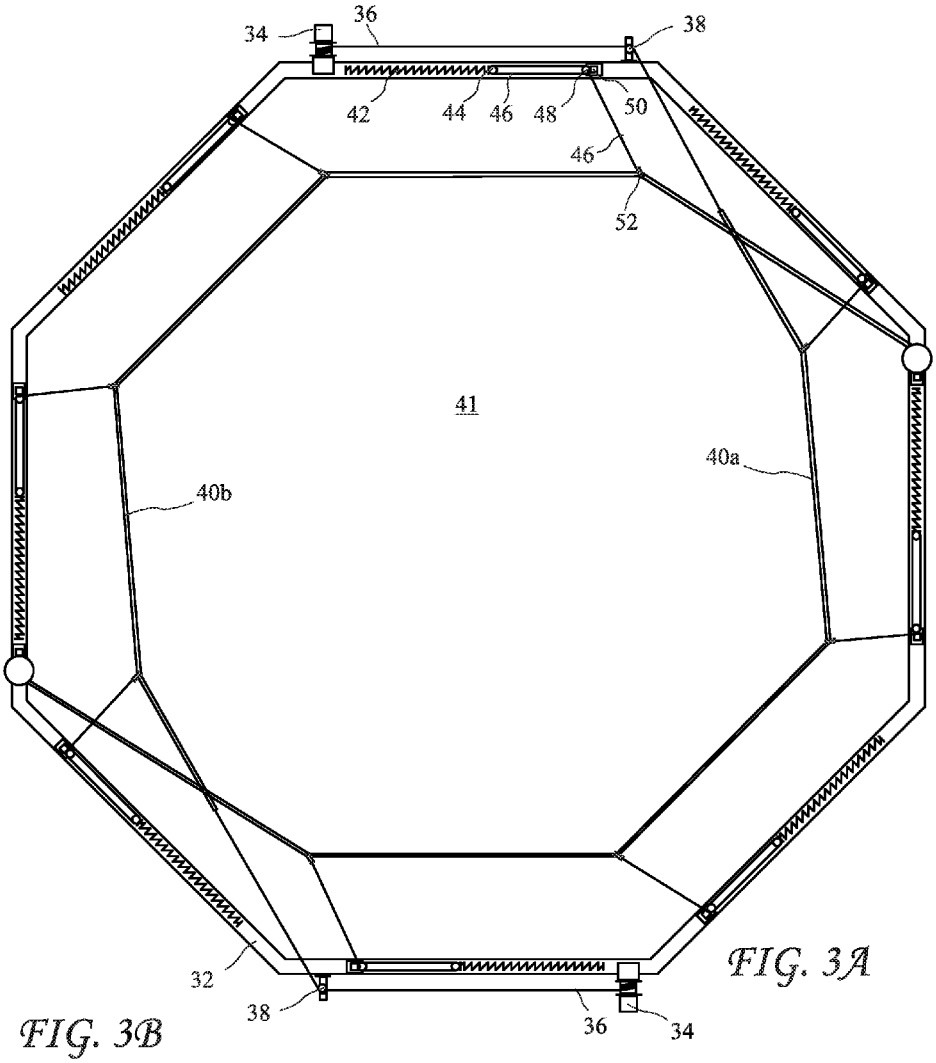
FIG. 3A
FIG. 3B
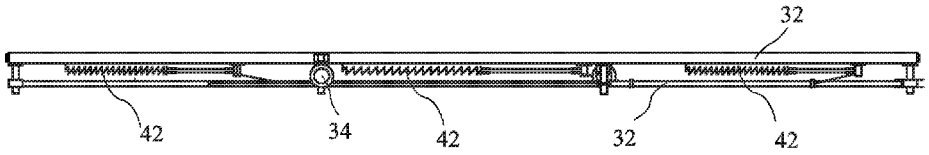

EXHAUST INTAKE BONNET (EIB) FOR MARITIME EMISSIONS CONTROL SYSTEM

BACKGROUND OF THE INVENTION

The present invention relates to the reduction of emissions from Ocean Going Vessels (OGVs), and more particularly to an improved Exhaust Intake Bonnet (EIB) for capturing and processing emissions from OGVs.

A substantial quantity of pollutants are produced by burning fuel in OGVs. The pollutants produced when an engine burns bunker and/or diesel fuel is a complex mixture of thousands of gases and fine particles, commonly known as soot, which contains more than forty toxic air contaminates. These contaminates include arsenic, benzene, and formaldehyde along with other ozone-forming pollutants that are components of smog and acid rain, such as carbon dioxide ($CO_2$), sulphur dioxide ($SO_2$), and nitrogen oxides ($NO_X$). An OGV may create and exhaust as much $NO_X$ as 12,500 automobiles or as an oil refinery, and thus is a substantial health risk to port workers and residents of surrounding communities, and may physically damage structures and equipment.

U.S. Pat. No. 7,258,710 for "Maritime Emissions Control System," assigned to the assignee of the present invention, describes a mobile emissions control system which may be transported to a ship within a harbor, and which mobile emissions control system captures and processes a main exhaust flow from the ship to reduce emissions. The main exhaust flow may be from the ship's engine(s), auxiliary generators, or any other source of exhaust from the ship. The emissions control system of the '710 patent includes a shroud which is lowered over the ship's stack. Although the shroud described in the '710 patent is adequate in most cases, in some situation, for example in heavy winds, the bonnet of the '710 patent may be difficult to position.

BRIEF SUMMARY OF THE INVENTION

The present invention addresses the above and other needs by providing an improved Exhaust Intake Bonnet (EIB) for an Advanced Maritime Emissions Control System (AMECS) which includes a shroud carried by a rigid upper frame and a lowerable and raisable rigid lower frame. The upper frame includes a peak with a duct for receiving exhaust gasses captured by the shroud and winches for lowering and raising the lower frame. The shroud is expandable when the lower frame is lowered and collapsible when the lower frame is raised and has a cinchable base. The AMECS is joined to a ship by positioning the EIB over a ship's exhaust stack using a deployment arm. The shroud is then lowered over the stack and then cinched around the stack to provide a soft attachment between the EIB and the ship's stack. Later, the steps are reversed to separate the AMECS from the ship.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 3A is a bottom view of the rigid lower frame showing a cinching strap and cinching assembly according to the present invention.

FIG. 3B is a side view of the rigid lower frame.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
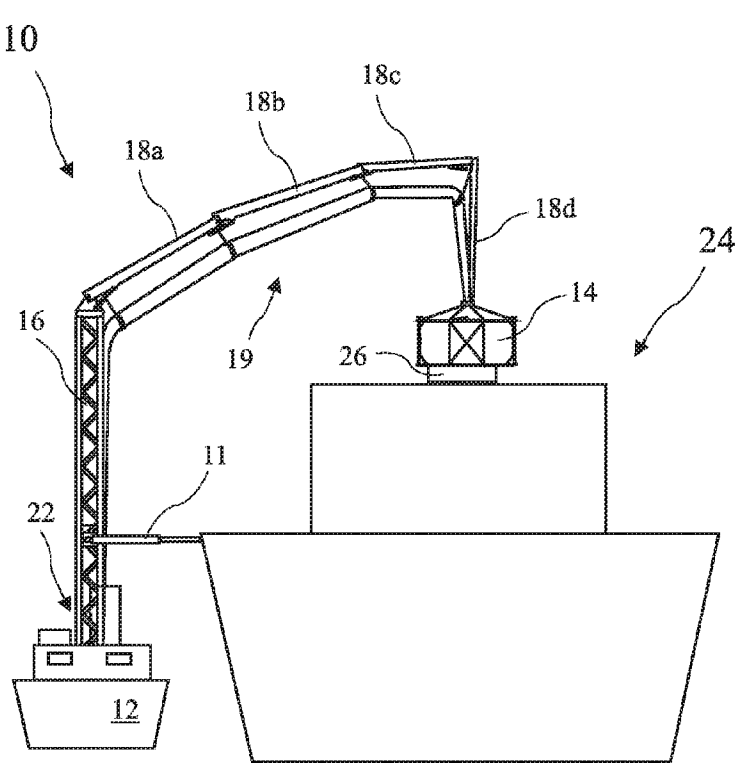
FIG. 1B is the AMECS and OGV with the EIB according to the present invention lowered over the stack of the OGV.
Figure 1A:
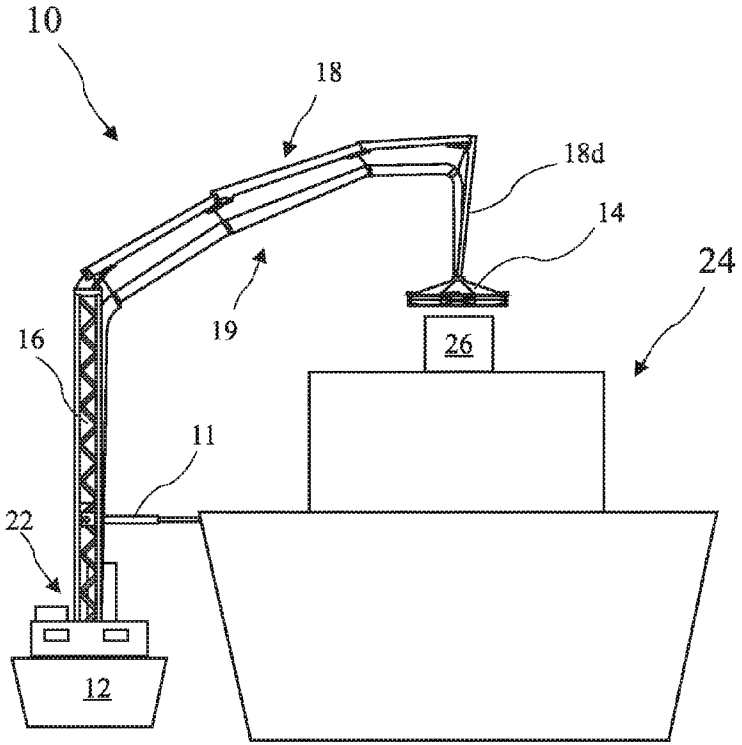
FIG. 1A is an Advanced Maritime Emissions Control System (AMECS) and Ocean Going Vessel (OGV) with an Exhaust Intake Bonnet (EIB) according to the present invention positioned above a stack of the OGV.

An Advanced Maritime Emissions Control System (AMECS) 10 and Ocean Going Vessel (OGV) 24 with an improved Exhaust Intake Bonnet (EIB) 14 according to the present invention positioned above a stack 26 of the OGV 24 is shown in FIG. 1A. The AMECS 10 comprises a tower 16, an articulating arm 18 extending from the tower 16, a duct 19 carried by the articulating arm 18, the EIB 14 carried at the end of the duct 19, and an emissions control unit 22 at an opposite end of the duct 19. The AMECS 10 preferably resides on an Unpowered Seagoing Barge (USB) 12 but may reside on a powered vessel. The articulating arm 18 may comprise several segments, and preferably comprises four segments 18*a*, 18*b*, 18*c*, and 18*d*. A stabilizing arm 11 may connect the tower 16 to the OGV 24.

An AMECS is described in detail in U.S. Pat. No. 7,258,710 for "Maritime Emissions Control System," assigned to the assignee of the present invention, details of an improved emissions control unit are described in U.S. Pat. No. 7,275,366 for "High Thermal Efficiency Selective Catalytic Reduction (SCR) System," also assigned to the assignee of the present invention, and a further improved emissions control unit are described in U.S. patent application Ser. No. 11/092, 477 for "Air Pollution Control System for Ocean-going Vessels," also assigned to the assignee of the present invention. The '710 and '366 patents and the '477 patent application are herein incorporated by reference.

The EIB 14 is shown collapsed in FIG. 1A to provide a minimum profile to wind and the AMECS 10 and OGV 24 with the EIB 14 lowered (or expanded) over the stack 26 of the OGV 24 is shown in FIG. 1B.

Figure 2A:
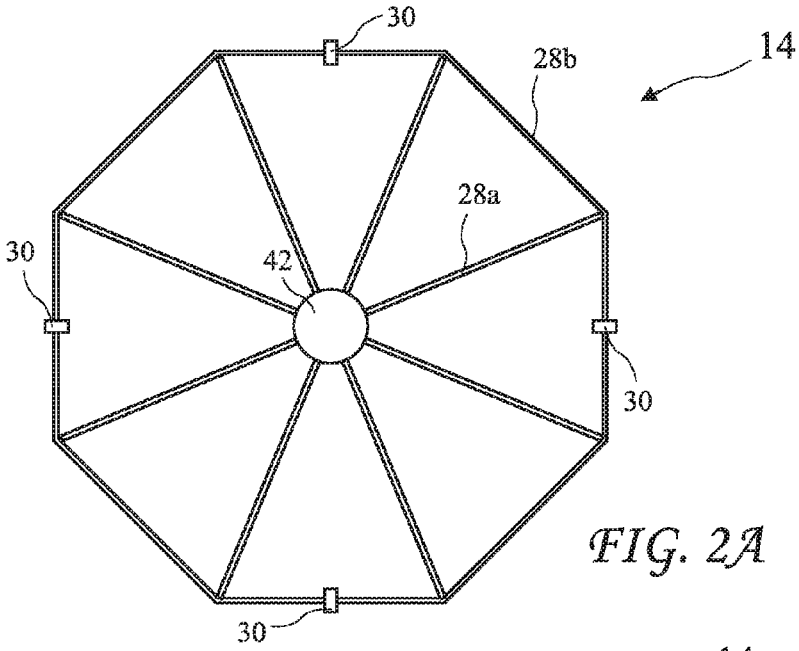
FIG. 2A is a top view of the EIB according to the present invention.
Figure 2B:
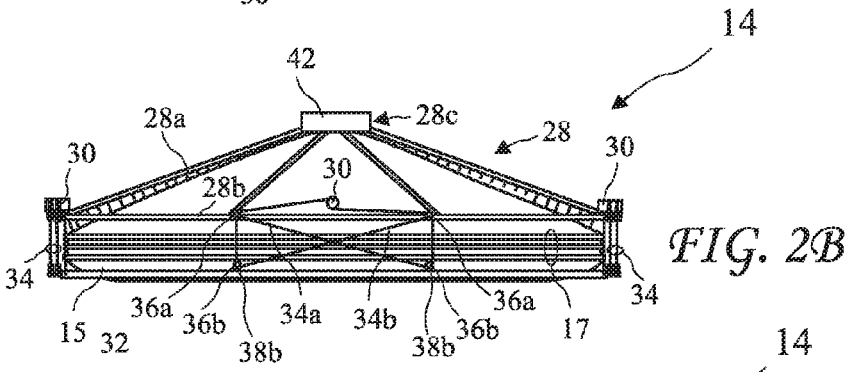
FIG. 2B is a side view of the EIB according to the present invention with a rigid lower frame in a raised position and a shroud residing in the EIB collapsed.
Figure 2C:
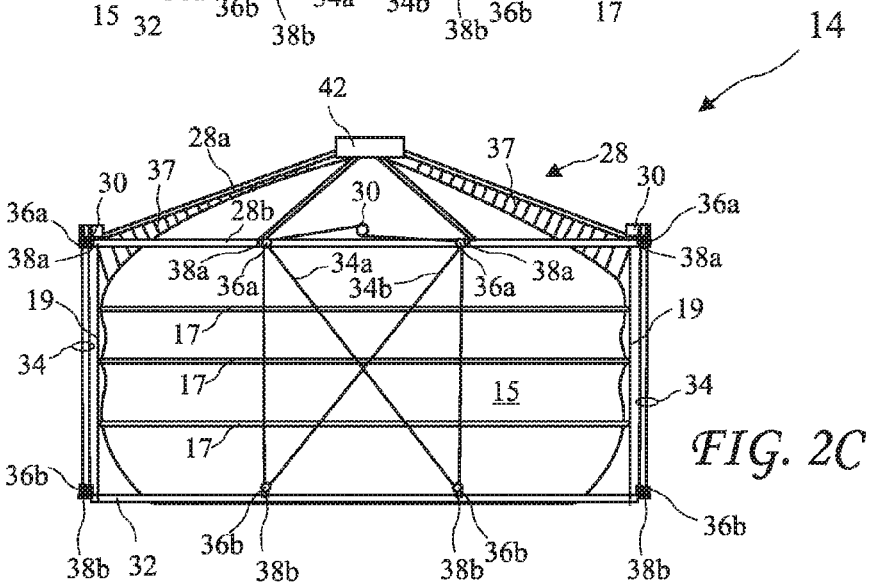
FIG. 2C is a side view of the EIB according to the present invention with the rigid lower frame in a lowered position and the shroud residing in the EIB expanded.

A top view of the improved EIB 14 according to the present invention is shown in FIG. 2A, a side view of the EIB 14 in a collapsed position is shown in FIG. 2B, and a side view of the EIB 14 in an expanded position is shown in FIG. 2C. The EIB 14 includes a rigid upper frame 28 comprising an outer ring 28*b* and diagonal runners 28*a* running inward and upward from the outer ring 28*b* to a peak 28*c* of the upper frame, and a rigid lower frame 32. Between three and eight, and preferably four, rigid middle frames 17 are vertically spaced between the upper frame 28 and the lower frame 32 and are connected to the upper frame 28 and the lower frame 32 by vertical cables 19. The upper frame 28 and the lower frame 32 have an outline of preferably a regular polygon and more preferably a regular octagon. Four lowering winches 30 are attached to the outer ring 28*b* approximately centered on four approximately 90 degree spaced apart sides of the outer ring 28*b*. The winches 30 may be split-drum or double drum. One pair of lowering ropes 34*a* and 34*b* is connected to each of the four lowering winches 30. Each lowering rope 34*a* and 34*b* extends approximately horizontally away from each winch 30 to an upper lowering pulley 36*a* attached to the outer ring 28*b* by a bracket 38*a*, diagonally to a lower lowering pulley 36*b* connected to the lower frame 32 by a bracket 38*b*, and approximately vertically to connect to the outer ring 28*b*. Such arrangement of lowering ropes provides stability during lowering and raising the lower frame 32.

A shroud 15 resides inside the EIB 14 and contains exhaust gases captured by the EIB 14. The shroud 15 is attached to the upper frame 28 and the middle frames 17 by straps 37 and rises into the upper frame 28 and is in fluid communication with a duct connector 42 which connects to the duct 19. The shroud 15 is made from a high-temperature material, and preferably is made from a Teflon®-coated Kevlar fabric. The shroud 15 is preferably, but not necessarily, spherical in shape, which provides a low drag coefficient and limits the effect of wind on the EIB 14.

A bottom view of the rigid lower frame 32 showing a cinching strap comprising cinching strap segments 40*a* and 40*b*, cinching assemblies, and tensioning assemblies is shown in FIG. 3A, and a side view of the rigid lower frame 32 is shown in FIG. 3B. The cinching strap segments 40*a* and 40*b* combine to a cinching strap enclosing a mouth 41 which may be lowered over the stack 26. The cinching assemblies comprise a cinching winch 34 and a cinching rope 36 according to the present invention. The cinching winches are attached to the lower frame 32 and cinching ropes 46 are connected between the cinching winches and first ends of the cinching strap segments. After the lower frame 32 has been lowered over the stack 26 (see FIG. 1B), the cinching winches 34 draw the cinching rope 36 in, and thereby cinch the cinching strap. A cinching rope pulley 38 may be attached to the lower frame 32 to provide clearance between the cinching assemblies and the tensioning assemblies, and to provide a suitable geometry for cinching. The cinching strap 40*a*, 40*b* is preferably made of a high temperature material, for example, Kevlar.

The tensioning assemblies comprise tensioning ropes 46, tensioning devices 42, and tensioning rope pulleys 44 and 48 according to the present invention. The tensioning devices 42 are preferably coil springs 42 attached to the lower frame 32 and the pulleys 44 and 48 may be may be split-drum or double drum pulleys. The pulley 44 is attached to the spring 42 opposite to the lower frame 32 and the pulley 48 is attached to the lower frame 32 by a bracket 50. In a preferred embodiment, the tensioning rope 46 loops around the tensioning pulleys 44 and 48 twice to provide a four to one ratio between the tensioning ropes 46 and the tensioning springs 42 (i.e., one unit of movement of the ropes 46 corresponds to ¼ unit of movement of the spring 42). The end of the tensioning rope 46 is attached to one of the cinch strap segments 40*a* and 40*b*, thereby approximately centering the cinch strap in the mouth 41.

Figure 4:
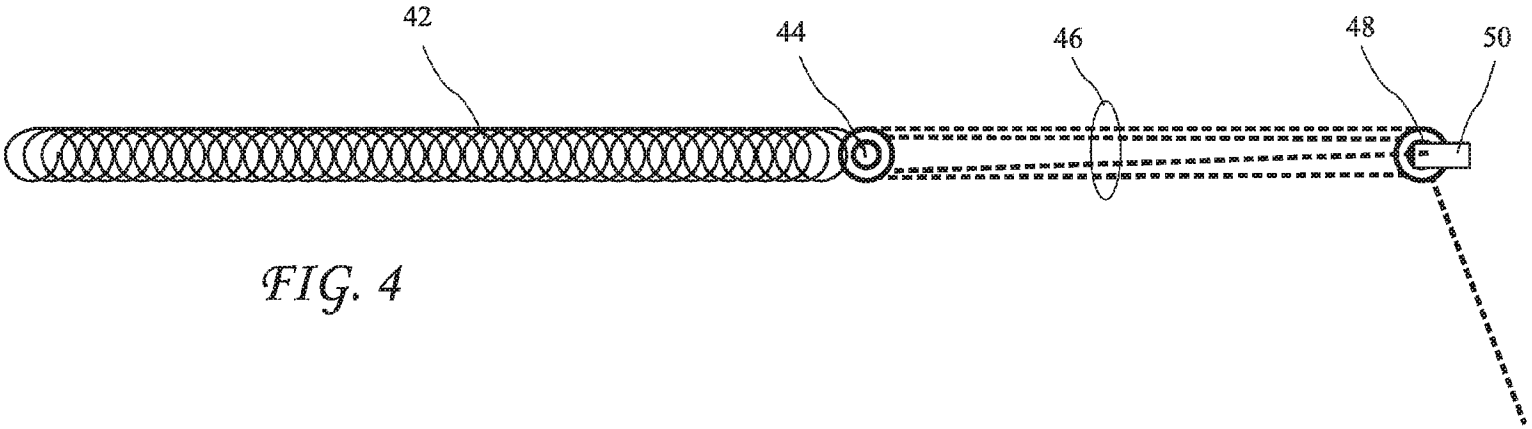
FIG. 4 shows a spring, rope, and pulley assembly for positioning a cinching strap according to the present invention.
Figure 5:
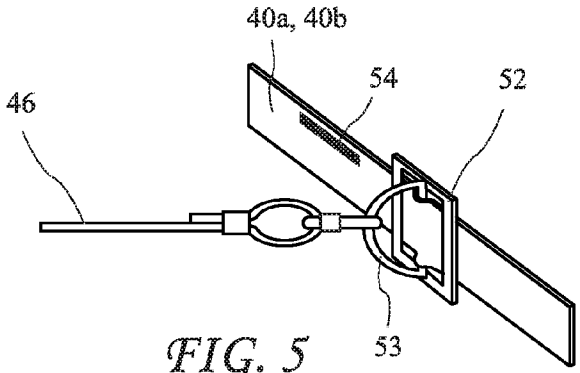
FIG. 5 shows the attachment of the rope to the cinching strap.

Details of the tensioning assembly are shown in FIG. 4 and details of the attachment of the cinching rope 46 to the cinching strap 40*a*, 40*b* are shown in FIG. 5. The tensioning assemblies provide a soft and conforming connection to the stack 26. As the cinching winches 34 draw in the cinching strap 40*a*, 40*b*, the springs 42 are stretched and provide potential energy to withdraw the cinching strap 40*a*, 40*b*. Upon disengagement of the EIB 14 from the stack 26, the winches 34 may run in reverse direction or free spin. The springs 42 and ropes 46 draw the cinching strap 40*a*, 40*b* away from the stack 26 to the original position. The tensioning spring 42, is attached to the tensioning rope 46 by a pulley 44, and the tensioning rope 46 loops twice between the pulley 44 and the pulley 48 attached to the lower frame 32. The opposite end of the tensioning strap 46 is attached to the cinching strap 40*a*, 40*b* by a "D" ring 53 and buckle 52 for positioning the cinching strap 40*a*, 40*b*. A slot 54 is provided for attaching the shroud 15 to the cinching strap 40*a*, 40*b*. Each cinching strap segment 40*a* and 40*b* may be held by between two and four tensioning assemblies and is preferably held by four tensioning assemblies.

Figure 6B:
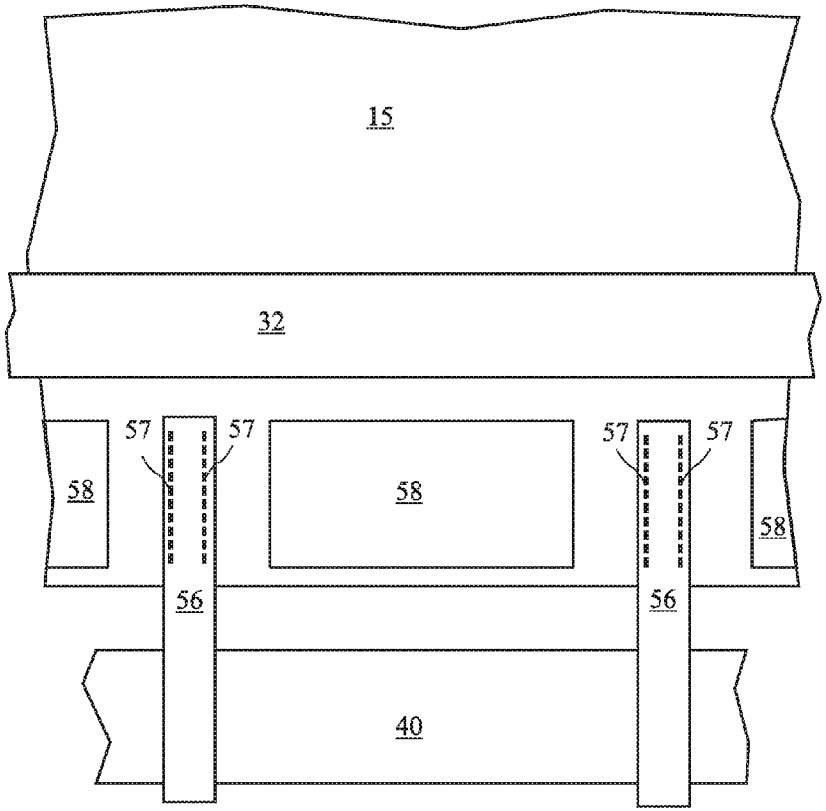
FIG. 6B shows a front view of the first embodiment of the shroud attachment to the cinching strap according to the present invention.
Figure 6A:
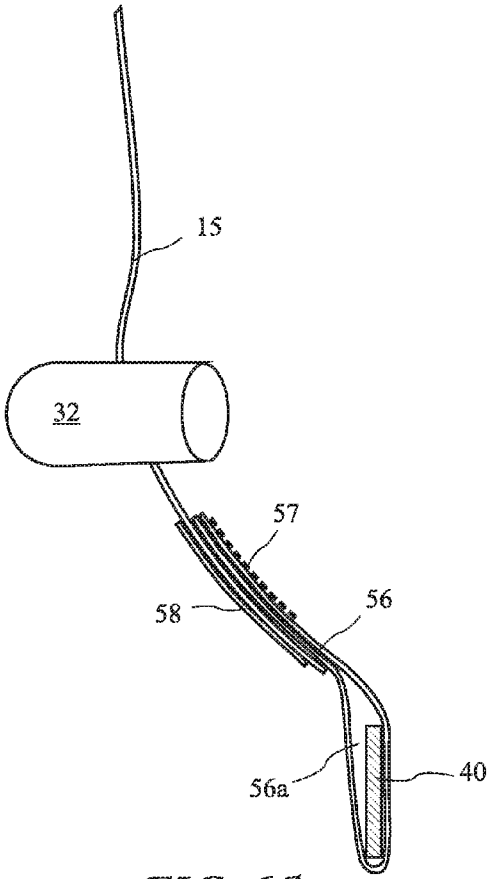
FIG. 6A shows an edge view of a first embodiment of the shroud attachment to the cinching strap according to the present invention.

An edge view of a first embodiment of the shroud 15 attachment to the cinching strap 40*a*, 40*b* is shown in FIG. 6A and a front view of the first embodiment of the shroud 15 attachment to the cinching strap 40*a*, 40*b* is shown in FIG. 6B. Straps 56 forming loops 56*a* are attached to the base of the shroud 15 by stitching 57. The cinching strap 40*a*, 40*b* passes through the loops 56*a* to attach the shroud 15 to the cinching strap 40*a*, 40*b*.

Additionally, an emergency pressure relief mechanism, most desirably flaps 58, may be located on the lowermost portion of the shroud 15 and open if there is a potentially catastrophic over pressure in the EIB 14. The flaps 58 are preferably made from material similar to, or the same as, the material used to make the shroud 15. The flaps 58 are preferably sewn along one edge and fastened to the shroud 15 along the other three edges of the flaps 58 using a tear away attachment such as hook and loop fastener material and the like. Alternatively, the length of or tension on the cinching straps 40*a*, 40*b* may be adjustable in order to provide a gap around the stack 26 perimeter for exhaust gasses to escape if there is an over pressure in the EIB 14. The flaps 58 may alternatively reside on the shroud 15 between the diagonal runners 28*a* of the rigid upper frame 28 (see FIG. 2B).

Figure 7B:
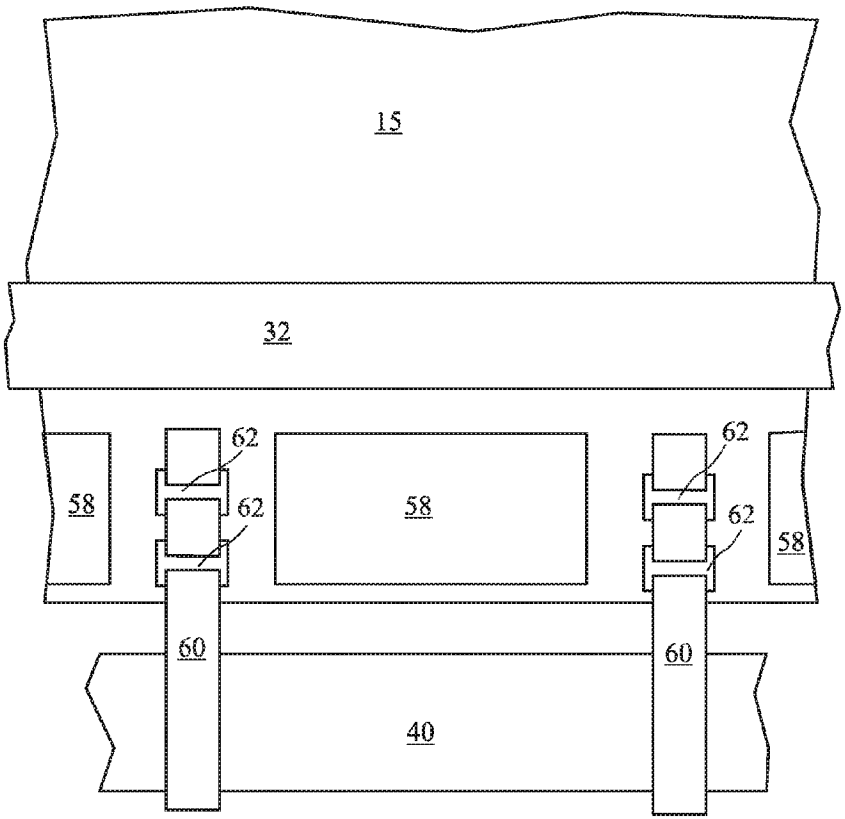
FIG. 7B shows a front view of the second embodiment of the shroud attachment to the cinching strap according to the present invention.
Figure 7A:
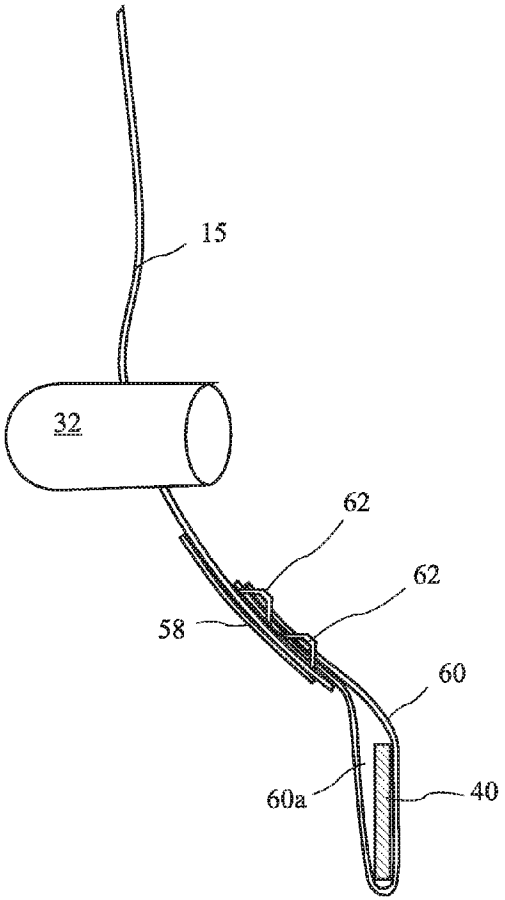
FIG. 7A shows an edge view of a second embodiment of the shroud attachment to the cinching strap according to the present invention.

An edge view of a second embodiment of the shroud 15 attachment to the cinching strap 40*a*, 40*b* according to the present invention is shown in FIG. 7A and a front view of the second embodiment of the shroud attachment to the cinching strap is shown in FIG. 7B. The bottom end of the shroud 15 is attached to the cinching strap 40*a*, 40*b* by a number of straps 60 which form loops 60*a* around the cinching strap 40*a*, 40*b* and terminate through the use of buckles 62. The second embodiment is otherwise similar to the first embodiment and includes the flap 58.

Figure 8B:
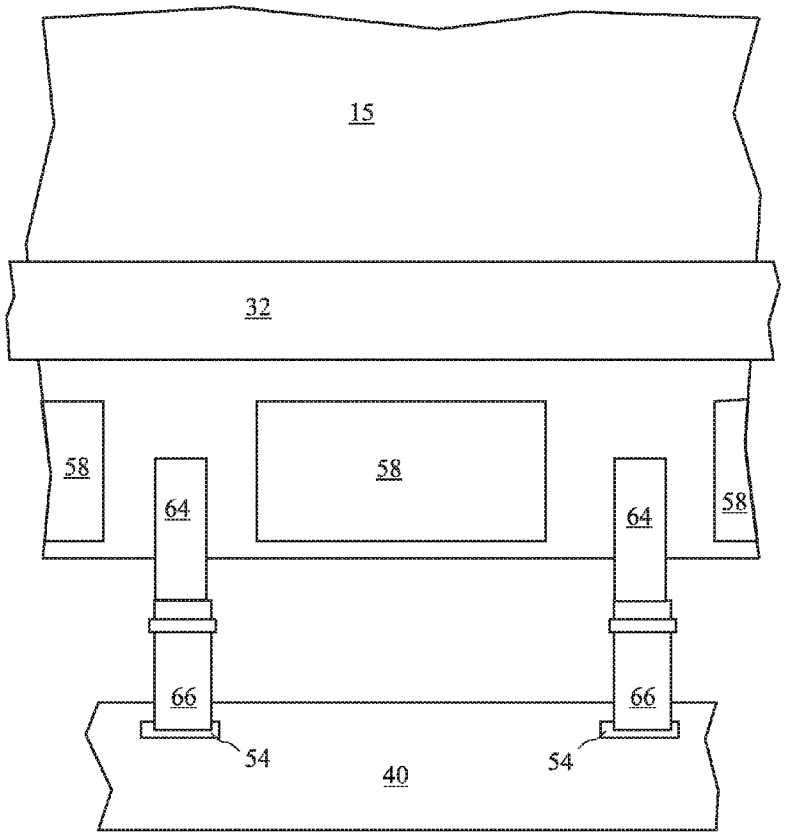
FIG. 8B shows a front view of the third embodiment of the shroud attachment to the cinching strap according to the present invention.
Figure 8A:
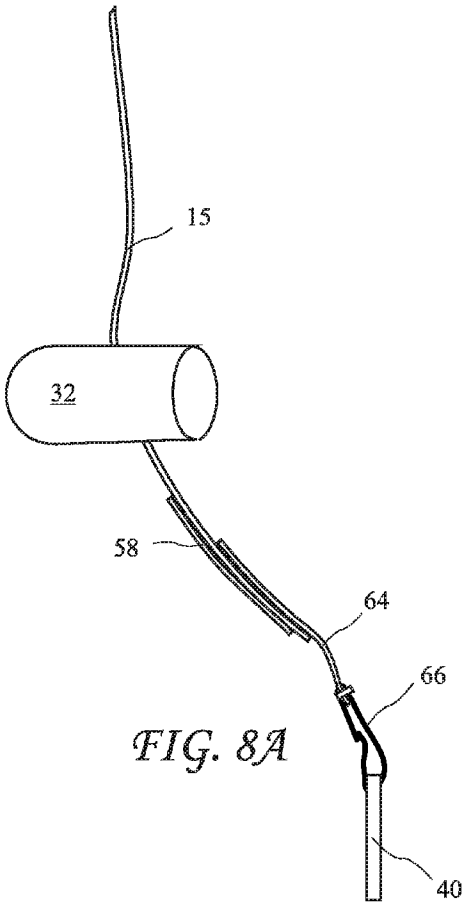
FIG. 8A shows an edge view of a third embodiment of the shroud attachment to the cinching strap according to the present invention.

An edge view of a third embodiment of the shroud 15 attachment to the cinching strap 40*a*, 40*b* according to the present invention is shown in FIG. 8A and a front view of the third embodiment of the shroud 15 attachment to the cinching strap 40*a*, 40*b* is shown in FIG. 8B. Straps 66 are attached to the shroud 15 and are connected to the cinching strap 40*a*, 40*b* by hooks 66 passing through slots 54 in the cinching strap 40*a*, 40*b*. The third embodiment is otherwise similar to the first embodiment and includes the flap 58.

While various ropes are described above, other similar means may be used to connect elements of the present invention, and an otherwise similar device replacing the ropes with wire rope, cables, cords, wires, and the like, is intended to come with the scope of the present invention.

While the invention herein disclosed has been described by means of specific embodiments and applications thereof, numerous modifications and variations could be made thereto by those skilled in the art without departing from the scope of the invention set forth in the claims.

We claim:

1. An Exhaust Intake Bonnet (EIB) for an Advanced Maritime Emissions Control System (AMECS), the EIB comprising:

a horizontally residing upper frame having a peak;

a duct connector horizontally centered on the upper frame and residing near the peak of the upper frame;

a horizontally residing ridged lower frame residing under the upper frame and having approximately a same horizontal outline as the upper frame;

at least one lowering winch;

at least one lowering rope attached to the lowering winch, the lowering rope connecting the lower frame to the upper frame for raising the lower frame towards the upper frame and lowering the lower frame away from the upper frame;

a vertically collapsible shroud residing between the upper frame and the lower frame;

a top of the shroud attached to the upper frame and in fluid communication with the duct connector;

about three vertically spaced apart horizontally residing rigid middle frames attached to the shroud between the upper frame and the lower frame;

a cinchable base of the shroud connected to the lower frame;

a cinching strap attached to the cinchable base of the shroud; and at least one cinching apparatus attached to the lower frame and to the cinching strap to cinch the base of the shroud.

2. The EIB of claim 1, wherein the at least one lowering winch comprises four lowering winches and the at least one lowering rope comprises four lowering ropes.

3. The EIB of claim 1, wherein the upper frame and the lower frame have fixed perimeters.

4. The EIB of claim 2, wherein:

each lowering winch is approximately centered on one of four approximately 90 degree spaced apart sides of the upper frame;

the four lowering ropes comprise four pairs of lowering ropes;

each pair of lowering ropes is connected to one of the four lowering winches; and each lowering rope extends approximately horizontally to an upper lowering pulley connected to the upper frame, diagonally to a lower lowering pulley connected to the lower frame, and vertically to connect to the upper frame.

5. The EIB of claim 1, wherein:

the lower frame has a fixed size and shape and the raising and lowering of the lower frame is vertical motion having no horizontal component;

the cinching strap is centered on the lower frame by cinching strap tensioner assemblies connecting the cinching strap to the lower frame;

the cinching strap comprises at least two cinching strap segments;

the cinching apparatus comprises at least two cinching apparatuses, one of the at least two cinching apparatuses connected to an end of each cinching strap; and the shroud is cinchable around an Ocean Going Vessel (OGV) stack by cinching of the cinch the at least two cinching apparatuses.

6. The EIB of claim 5, wherein the cinching strap tensioner assemblies comprise tensioning ropes connected to the lower frame by tensioning devices.

7. The EIB of claim 6, wherein the tensioning devices are tensioning springs.

8. The EIB of claim 7, wherein the cinching strap tensioner assemblies further include tensioning pulleys cooperating with the tensioning ropes to provide a four to one ratio between the tensioning ropes and the tensioning springs.

9. The EIB of claim 5, wherein each of the cinching apparatus comprises a cinching winch and a cinching rope connected between the lower frame and the end of the cinching strap.

10. The EIB of claim 1, wherein the upper frame comprises an outer ring and approximately equal length diagonal runners connecting the outer ring to the peak.

11. The EIB of claim 10, wherein the outer ring has an octagonal shape and the diagonal runners extend from corners of the outer ring to the peak.

12. An Exhaust Intake Bonnet (EIB) for an Advanced Maritime Emissions Control System (AMECS), the EIB comprising:

a horizontally residing upper frame having a fixed horizontal outline and an approximately centered peak;

a duct connector approximately horizontally centered on the upper frame and residing near the peak of the upper frame;

a horizontally residing lower frame residing under the upper frame and having approximately the same fixed horizontal outline as the upper frame;

angularly spaced apart lowering winches on the upper frame;

lowering ropes attached to the lowering winches, the lowering ropes connecting the lower frame to the upper frame for vertically raising the lower frame towards the upper frame and vertically lowering the lower frame away from the upper frame;

a vertically collapsible shroud residing between the upper frame and the lower frame;

a top of the shroud attached to the upper frame and in fluid communication with the duct connector;

a cinchable base of the shroud connected to the lower frame; and a cinching strap attached to the cinchable base of the shroud, wherein shortening the cinching strap cinches the cinchable base of the shroud.

13. An Advanced Maritime Emissions Control System (AMECS) comprising:

an arm for positioning an Exhaust Intake Bonnet (EIB) above a stack of an Ocean Going Vessel (OGV);

the EIB comprising:

a fixed perimeter horizontally residing upper frame comprising an outer ring and diagonal runners running inward and upward from the outer ring to a peak of the upper frame;

a duct connector horizontally centered on the upper frame and residing near the peak of the upper frame;

a fixed perimeter horizontally residing lower frame residing under the upper frame and having approximately a same perimeter as the upper frame, the lower frame having:

a raised first position proximal to the upper frame creating a small vertical extent to allow the EIB to be positioned in a high wind; and a second lowered position distal from the upper frame allowing the EIB capture a ships exhaust;

at least one lowering winch;

at least one lowering rope attached to the lowering winch, the lowering rope connecting the lower frame to the upper frame for raising the lower frame towards the upper frame and lowering the lower frame away from the upper frame and over the OGV stack;

a vertically collapsible shroud residing between the upper frame and the lower frame;

a top of the shroud attached to the upper frame and in fluid communication with the duct connector;

a cinchable base of the shroud connected to the lower frame;

a cinching strap attached to the cinchable base of the shroud; and at least one cinching apparatus attached to the lower frame and to the cinching strap to cinch the base of the shroud around the OGV stack;

a duct carried by the arm and having a first end connected to the duct connector;

an emissions control unit connected to a second end of the duct for receiving exhaust captured by the EIB and processing the exhaust.

14. The EIB of claim 12, wherein:

the lower frame comprises a regular polygon;

the cinching strap comprises two cinching strap segments residing inside the lower frame;

cinching winches are attached to two opposite sides of the lower frame;

one cinching rope is attached to each cinching winch and may be drawn and released by the associated cinching winch;

first ends of the two cinching strap segments are attached to the associated cinching ropes and the cinching strap segments may be drawn and released by the associated cinching winch;

opposite ends of each cinching strap segment are fixedly attached to the lower frame; and intermediate points between the first ends and the opposite ends of each cinching strap segment are connected to the lower frame by tensioning devices maintaining tension on the intermediate points along each cinching strap segment outwards towards the lower frame.

15. The EIB of claim 14, wherein:

the lower frame comprises a horizontally residing regular octagon;

the tensioning devices comprise eight tensioning devices, one residing along each side of the lower frame; and the intermediate points comprise four intermediate points along each cinching strap segment.

16. The EIB of claim 15, wherein each of the eight tensioning devices comprise:

a spring having a first spring end fixedly attached to the lower frame proximal to a first end of each side of the lower frame;

each of the eight cinching ropes attached to an opposite spring end; and a pulley fixedly attached to the lower frame proximal to an opposite end of each side of the lower frame, each cinching rope wrapping around each respective pulley.

17. The EIB of claim 12, wherein the cinching strap resides below the lower frame.

18. The EIB of claim 12, wherein the pressure relief flaps are provided along a lower edge of the shroud and open in the event of over pressure within the shroud.

19. The EIB of claim 12, wherein at least one horizontally residing rigid middle frame is attached to the shroud between the upper frame and the lower frame.

20. The EIB of claim 13, wherein at least one horizontally residing rigid middle frame is attached to the shroud between the upper frame and the lower frame.

* * * * *